US010047298B2

(12) United States Patent
Hinson et al.

(10) Patent No.: US 10,047,298 B2
(45) Date of Patent: Aug. 14, 2018

(54) INTERNAL LINING FOR DELAYED COKER DRUM

(71) Applicants: Christopher S. Hinson, Calgary (CA); Christopher John Fowler, Houston, TX (US); David Scott Sinclair, Houston, TX (US); Adam Garrett Susong, Washington, DC (US); Robert Lee Antram, Warrenton, VA (US); John Roger Peterson, Ashburn, VA (US)

(72) Inventors: Christopher S. Hinson, Calgary (CA); Christopher John Fowler, Houston, TX (US); David Scott Sinclair, Houston, TX (US); Adam Garrett Susong, Washington, DC (US); Robert Lee Antram, Warrenton, VA (US); John Roger Peterson, Ashburn, VA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 320 days.

(21) Appl. No.: 14/641,903

(22) Filed: Mar. 9, 2015

(65) Prior Publication Data

US 2015/0267122 A1 Sep. 24, 2015

Related U.S. Application Data

(60) Provisional application No. 61/951,614, filed on Mar. 12, 2014, provisional application No. 61/992,316, filed on May 13, 2014.

(51) Int. Cl.
*C10G 9/18* (2006.01)
*C10G 9/00* (2006.01)
(Continued)

(52) U.S. Cl.
CPC ..... *C10G 9/18* (2013.01); *C10B 1/04* (2013.01); *C10B 39/06* (2013.01); *C10B 43/14* (2013.01);
(Continued)

(58) Field of Classification Search
CPC .. C10G 9/005; C10G 9/04; C10G 9/18; C10B 1/04
See application file for complete search history.

(56) References Cited

U.S. PATENT DOCUMENTS 1,823,451 A 9/1931 Hencken
2,702,269 A 2/1955 Geller
(Continued)

OTHER PUBLICATIONS

Chung, DDL., Materials for Thermal Conduction, Applied Thermal Engineering 21 (2001), pp. 1593-1605.*
(Continued)

*Primary Examiner* — Renee Robinson
(74) *Attorney, Agent, or Firm* — Glenn T. Barrett; Andrew T. Ward

(57) ABSTRACT

A delayed coking unit has a thermal shock-resistant, erosion-resistant internal lining to reduce thermally-induced mechanical stresses in the pressure boundary of the coke drum. The lining is effective to reduce or mitigate the transient thermal stress that occurs in the pressure boundary of the coke drum and to reduce or minimize the high thermal stress resulting from temperature differentials at the skirt-to-shell junction.

30 Claims, 3 Drawing Sheets

(51) Int. Cl.

| | |
|---|---|
| ***C10B 1/04*** | (2006.01) |
| ***C10G 9/04*** | (2006.01) |
| ***C10B 55/00*** | (2006.01) |
| ***C10B 39/06*** | (2006.01) |
| ***C10B 43/14*** | (2006.01) |
| ***C10B 57/04*** | (2006.01) |
| ***C10B 57/08*** | (2006.01) |

(52) U.S. Cl.
CPC ..... *C10B 55/00* (2013.01); *C10B 57/045* (2013.01); *C10B 57/08* (2013.01); *C10G 9/005* (2013.01); *C10G 9/04* (2013.01)

(56) References Cited

U.S. PATENT DOCUMENTS

| | | | | |
|---|---|---|---|---|
| 3,657,851 | A * | 4/1972 | Chambers | F23M 5/04 52/334 |
| 3,738,217 | A * | 6/1973 | Walker | F16B 21/02 411/510 |
| 6,393,789 | B1 * | 5/2002 | Lanclos | B04C 5/085 110/338 |
| 6,843,889 | B2 | 1/2005 | Lah et al. | |
| 7,736,470 | B2 | 6/2010 | Chen et al. | |
| 8,221,591 | B2 | 7/2012 | de Para et al. | |
| 2008/0003125 | A1 | 1/2008 | Peterson et al. | |
| 2013/0153466 | A1 | 6/2013 | Axness et al. | |

OTHER PUBLICATIONS

PCT Application No. PCT/US2015/019832, Communication from the International Searching Authority, International Search Report and the Written Opinion, Forms PCT/ISA/220 and PCT/ISA/237, dated May 26, 2015, 14 pages.

L.P. Antalffy, D.W. Malek, J.A. Pfiefer, C.W. Stewart, B. Grimsley and R. Shockley, "Innovations in Delayed Coking Coke Drum Design", Proceedings of the Joint ASME/JSME Pressure Vessels and Piping, vol. 388, Aug. 1, 1999, pp. 207-217.

M. DelPrete, L. Saturno and D. Quintiliani, "Cladding of pressure equipment: case studies and the choice of various types of application. Case study: cladding in the fabrication of coke drums", Welding International, 2014, vol. 28, Nos. 7-9, 617-628.

P.J. Ellis and C.A. Paul., "Tutorial: Delayed Coking Fundamentals", AIChE 1998 Spring Nationai Meeting, New Orleans, LA, Mar. 8-12, 1998, Paper 29a.

* cited by examiner

INTERNAL LINING FOR DELAYED COKER DRUM

CROSS-REFERENCE TO RELATED APPLICATION

This application claims priority to U.S. Provisional Application Ser. No. 61/951,614 filed Mar. 12, 2014 and U.S. Provisional Application Ser. No. 61/992,316 filed May 13, 2014, both herein incorporated by reference in their entirety.

FIELD OF THE INVENTION

This invention relates to a method of extending the fatigue life of delayed coking coke drums used for the thermal processing of heavy petroleum oils and more particularly, to the use of internal linings in delayed coking coke drums for extending their fatigue life.

BACKGROUND OF THE INVENTION

Delayed coking is a process used in the petroleum refining industry for increasing the yield of liquid product from heavy residual oils such as vacuum resid.

In delayed coking, the heavy oil feed is heated in a furnace to a temperature at which thermal cracking is initiated but is low enough to reduce the extent of cracking in the furnace itself. The heated feed is then led into a large drum in which the cracking proceeds over an extended period of residence in the drum. The cracking produces hydrocarbons of lower molecular weight than the feed which, at the temperatures prevailing in the drum, are in vapor form and which rise to the top of the drum where they are led off to the downstream product recovery unit with its fractionation facilities. The thermal cracking of the feed that takes place in the drum also produces coke, which gradually accumulates in the drum during the delayed coking cycle. When the coke reaches a certain level in the drum, the introduction of the feed is terminated and the cracked products remaining in the drum are removed by purging with steam. After this, the coke is quenched with water, the drum is depressurized, the top and bottom heads are opened, and then the coke is discharged through the bottom head of the drum through use of a high pressure cutting water system. The cracking cycle is then ready to be repeated. Typically the process itself is achieved by heating the heavy oil feed to a temperature in the range that permits a pumpable condition in which it is fed into the furnace and heated to a temperature in the range of 380 to 525° C.; the outlet temperature of a coker furnace is typically around 500° C. with a pressure of 4 bar. The hot oil is then fed into the coke drum where the pressure is held at a low value in order to favor release of the vaporous cracking products, typically ranging from 1 to 6 bar, more usually around 2 to 3 bar. Large volumes of water are used in the quench portion of the coking cycle: one industry estimate is that for a typically large coke drum about 8 m in diameter and 25 m high, about 750 tonnes of water are required for quenching alone with even more required for the cutting operation after the drum is opened and the coke discharged. A useful and widely cited summary of the delayed coking process is available online in "Tutorial: Delayed Coking Fundamentals", Ellis et al, Great Lakes Carbon Corporation, Port Arthur, Tex., AIChE 1998 Spring National Meeting, New Orleans, La., 8-12 Mar. 1998, Paper 29a, Copyright ©1998 Great Lakes Carbon Corporation.

Delayed coking coke drums are conventionally large vessels, typically at least 4 and possibly as much as 10 m in diameter with heights of 10 to 30 m or even more. The drums are usually operated in twos or threes with each drum sequentially going through a charge-quench-discharge cycle, with the heated feed being switched to the drum in the feed phase of the cycle. The drums are typically made of unlined or clad steel, with base thicknesses that can range from about 10 to 30 mm thick. The internal cladding thickness is nominally 1-3 mm and is used for protection against sulfur corrosion. The present common commercial practice is to use 401S clad or unclad CS, C-1/2 Mo, or low chromium drums for delayed coking service. In form, the drums comprise vertical cylinders with either an ellipsoidal or hemispherical top head and a conical bottom head. The bottom head has either a flange or, alternatively, a mechanical valve arrangement as described, for example, in U.S. Pat. No. 6,843,889 (Lah). The feed inlet and steam/water connections are located in this lower conical section of the vessel. Operating envelopes and inspection/repair strategies are the mechanisms used to manage fatigue cracking in this equipment.

Delayed Coker coke drums are inherently exposed to pressure boundary fatigue cracking due to the thermal stresses imposed on the steel primarily during the quench/fill process. The drums are prone to thermal fatigue due to the through-wall thermal stresses that are developed prior to the drum reaching steady state. Additionally, at the skirt-to-shell junction, the transient temperature differentials between the pressure boundary and the skirt also set up high stresses that can lead to weld and base metal cracking. This is a transient effect, and data analysis has shown that the other delayed coking steps (e.g., drum warm-up, feed introduction, coking, steam out, etc.) have less impact on pressure boundary stresses. As noted by Ellis, op. cit., the rate of cooling water injection is critical. Increasing the flow of water too rapidly can "case harden" the main channels up through the coker without cooling all of the coke radially across the coke bed. The coke has low porosity which then allows the water to flow away from the main channels in the coke drum, leading to the problem of drum bulging during cool down. If the rate of water is too high, the high pressure causes the water to flow up the outside of the coke bed cooling the wall of the coke drum. Coke has a higher coefficient of thermal expansion than does steel (154 for needle coke versus 120 for steel, cm/cm/° C.$\times 10^{-7}$). While drum support systems such as that described in U.S. Pat. No. 8,221,591 (de Para) may be capable of reducing the mechanical stresses generated by the differential cooling, it would nevertheless by desirable to minimize the transient thermal stress in both the coke drum Shell/cone as well as at the skirt-to-shell junction.

SUMMARY OF THE INVENTION

We now propose the use of a thermal buffering system to reduce or minimize the transient thermal stress that occurs in the steel during the portions of the coking cycle when the thermal stresses arise. The application of a lining system applied to the internal surface of the coke drum pressure boundary will be effective to reduce stresses on the drum during the operation of the process, particularly during the cooling/quench portion of the cycle. Coverage of the pressure boundary with internal lining can vary from a few meters of vessel height to all of the pressure boundary depending on (1) the level of protection needed in historically problematic areas (i.e., at the skirt-to-shell junction, in the bottom cone, near the outage level, etc.), and/or (2) to address efforts to minimize cycle time via shorter quench phases, feed introduction at lower drum warm-up temperatures, etc.

According to one embodiment of the present invention, the delayed coker coke drum has a monolithic, thermal shock-resistant, erosion-resistant refractory lining on the inner surface of the drum, especially in the areas subject to pressure boundary stress. The monolithic lining, applied by ramming in a similar manner to air-setting erosion-resistant refractory, is held in place by a suitable anchoring system, preferably a single point anchoring system as discussed further below. Anchoring systems of this type are customarily used for anchoring erosion-resistant refractory linings in petroleum processing vessels and may be used for the present purposes.

In another embodiment of the present invention, the delayed coker coke drum includes the same aforementioned anchoring system, but does not include the air setting erosion-resistant refractory. In this embodiment, the coke being fed into the coke drum fills the anchoring system and the two form an internal lining on the inner surface of the drum. This allows the transient thermal stress to be dissipated across a layer of coke rather than across the coke drum pressure boundary.

In another embodiment of the present invention, the delayed coker coke drum includes a in and plate assembly. In this assembly, pins are provided extending inward from the outer wall of the coke drum. Attached to the pins are protective plates. The plates are arranged such that they create an air gap that will fill with a protective layer of coke between the coke being fed into the coke drum and the inner surface of the drum. This allows the transient thermal stress to be dissipated across the coke and the protective plates rather than across the coke drum pressure boundary. The protective plates prevent the removal of the protective coke layer during the cutting cycle.

DRAWINGS

DETAILED DESCRIPTION

Figure 1:
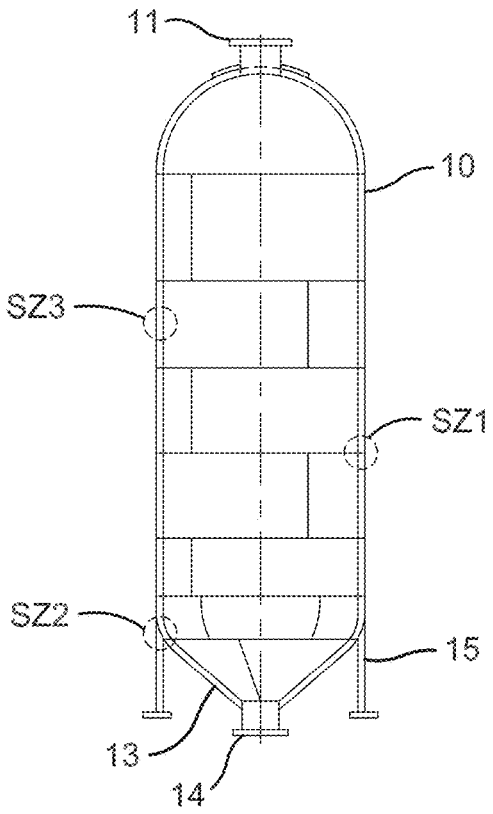
FIG. 1 is a simplified vertical section of a delayed coker coke drum showing potential areas for the application of the internal lining.

FIG. 1 shows a section of a typical delayed coker coke drum 10 with its flanged vapor discharge outlet 11 on the hemispherical head at the top of the drum. The bottom conical head 13 terminates in the flanged bottom coke discharge outlet 14. The drum is supported on a skirt, as indicated at 15. The feed inlet is not shown but may conventionally be provided either in the bottom head that flanges up to the discharge outlet 14 or in the conical section 13. If the inlet is fixed in the cone, multiple feed inlets are preferred as described in U.S. Pat. No. 7,736,470 (Chen); the feed inlets may be angled upwards as described in US 2013/0153466 (Axness).

Zones in the drum subject to pressure boundary stress are indicated in FIG. 1 as SZ1, SZ2, and SZ3. SZ1 indicates a typical weld area in the vertical cylindrical section of the drum where plates meet and cracking of the circumferential weld seams, base metal, and weld overlay/cladding is found. At SZ2 where the drum sits in the drum skirt (part of the drum support system welded to the drum around the lower periphery of the main cylindrical section), cracking of the skirt attachment weld and/or keyhole slots in the skirt is apt to be encountered. In the main cylindrical section of the drum at approximately SZ3, drum bulging may be encountered, with pressure boundary cracking at the bulge locations. In addition to circumferential weld, weld Heat-Affected Zone (HAZ), base metal, and internal cladding cracking, there have also been cases of cracking in the longitudinal weld seams and disbonding of the internal cladding.

According to the present invention, the delayed coker coke drum has a thermal shock-resistant lining applied to the inner surfaces of the drum. The lining has the function of reducing the thermally-induced mechanical stresses from the transient temperature cycles occurring during the delayed coking process, particularly common during the cooling/quench phase of the cycle, but present to a lesser extent during other phases. The lining is effective to minimize the transient thermal stress that occurs in the shell and bottom head and to reduce the high thermal stress resulting from temperature differentials at the skirt-to-shell junction.

Figure 2:
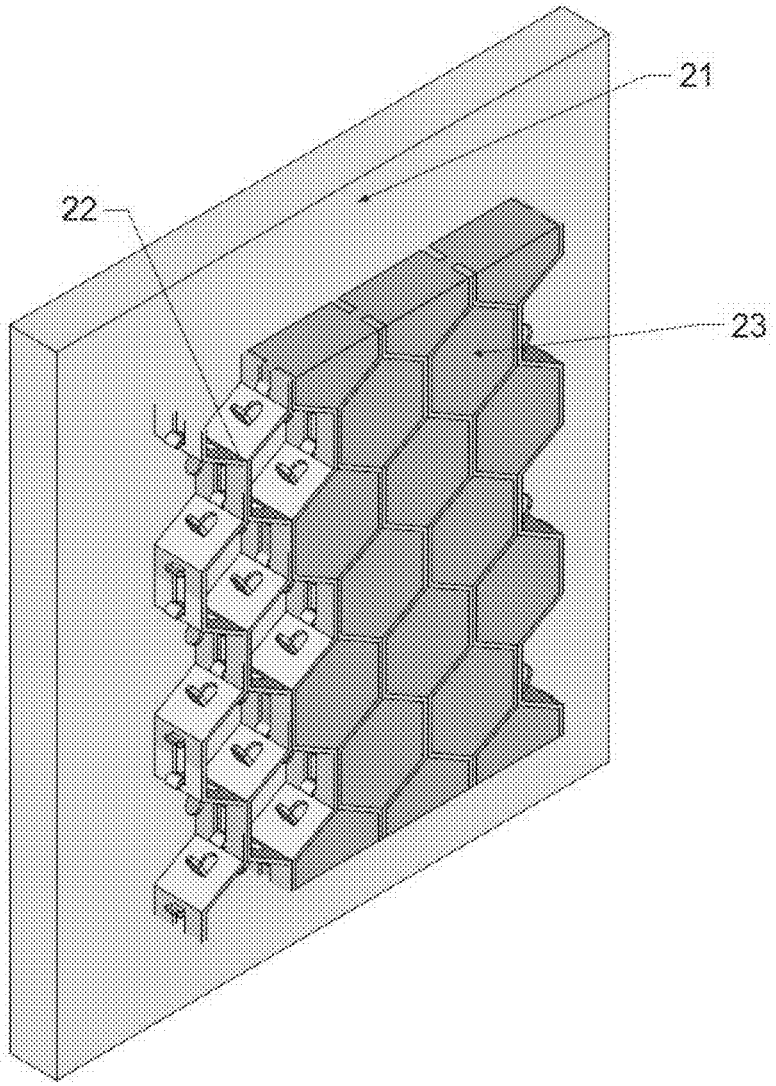
FIG. 2 illustrates an alternative embodiment of the internal lining of the present invention.

FIG. 2 shows an embodiment of the internal lining of the current invention. Anchoring system 22 is connected to the inner surface of pressure boundary 21. Anchoring system 22 forms the voids into which thermal barrier 23 can be inserted.

In one embodiment of the invention, thermal barrier 23 is a refractory material. The cyclic service of the drum is such that a brick lining is unlikely to be satisfactory due to its inability to handle the thermal loads in the through-thickness direction. Additionally, a heat-resistant, monolithic refractory lining is also unlikely to handle such thermal cycling loads due to an inadequate anchorage system common for such refractory types. According to one embodiment of the invention the use of a thin-layer (¾-2 inch (1.9-5 cm) nominally), thermally-shock resistant and erosion-resistant refractory lining is contained in appropriate anchorage that resists transient thermal loading.

Suitable refractories are those normally used for erosion-resistant linings in thermal processing units, such as those used in Fluid Catalytic Cracking Units (FCCUs), but with the essential qualifications that the erosion-resistant nature of the refractory also be thermal-shock resistant and capable of withstanding the cutting water pressure required to remove the coke from the drum as part of the normal decoking cycle. In all cases, the refractory should be selected to be as durable as possible. In view of the service requirements, three conceptual approaches are possible:

- Use a high strength refractory material that is filled with a high level of a low expansion refractory aggregate. The effect of the rapid temperature changes encountered during the quench cycle is then minimized by the reduced dimensional change from thermal expansion. The material imparts a thermal barrier that delays the heat transfer to the base shell material.
- Use a high strength refractory material that is filled with a high level of highly thermally conductive refractory aggregate. Rapid temperature changes are transmitted to the shell plate during the quench cycle. This minimizes the internal thermal stresses in the refractory material. The material imparts a minimal thermal barrier that more quickly transfers the heat to the base shell material yet provides adequate steel protection.
- Use a high strength refractory material that is filled with a high level of an aggregate that closely matches the thermal expansion of the base plate. The impact of rapid temperature changes encountered during the quench cycle is then minimized by the reduced dimensional change from thermal expansion. The material imparts a thermal barrier that delays the heat transfer to the base shell material.

The specific refractory material used to implement these approaches may be selected on an empirical basis from the many castable refractories of this type that are commercially available. Selection of the specific refractories may be made according to experience in other petroleum refining applications, relations with suppliers, etc., as is normally the practice. Qualification of the lining should be established by transient thermal cycle tests (simulating actual delayed coker quench/fill steps) to ensure optimized refractory/anchor system reliability.

An important feature of the drum linings is the anchoring system. Hexagonal mesh has been the preeminent thin layer lining system, typically available in standard thicknesses of ¾ inch (19 mm), 1 inch (25 mm) and 2 inch (50 mm), although other thicknesses can be custom made. Hexagonal mesh is composed of long ribbons and the resultant lining system is comprised of discrete refractory cells bound by a metallic cell formed by the ribbons. Attachment of these long ribbons to the base material results in accumulation of thermal strain across the attachment welds (typically at 25 mm distances) resulting in failure. For this reason, hexagonal mesh is unlikely to be optimal as an anchoring system for service in the coke drum and will not be preferred. Experience in FCC units with hexmesh in coking service has shown that when the welds start to break, coke accumulates with each thermal cycle until all the welds break and the section falls off as a sheet. If used, hexagonal mesh should be installed in discrete sections that could pass through the outlet nozzle and not impede unloading if they became detached.

Alternatives to hexagonal mesh are single point anchoring systems in which thermal strain is accumulated only across the individual weld (3-10 mm diameter): stud weldable anchoring systems that minimize the potential for accumulated thermal strain across multiple attachment welds are preferred. The resultant systems provide a continuous refractory system with discrete anchoring points where the failure of a single anchor is less detrimental to the lining system than failure of a sheet secured by hexmesh. Individual I Anchors such as the Silicon CVC anchors, Hex-Alt anchors (e.g., K-bars™, Half Hex™, etc.), such as those shown, for instance, in U.S. Pat. No. 6,393,789 (Lanclos), U.S. Pat. No. D393,588 (Tuthill), may be considered for potential use. An extensive range of refractory anchors is supplied commercially by the Hanlock-Causeway Company of Tulsa, Okla. and Houston, Tex. Wear-resistant anchors such as Hanlock, Flexmesh™, Tabs, hex cells, S-Anchor™ and stud gun weldable half hex cell anchors may also be useful. Typical anchoring systems are welded, usually by spot or stud welds to the underlying metal surface prior to application of the lining. Anchors should be welded directly to the surface (can be clad or unclad) of the coke drum, or alternatively, stud-welding technology may be employed for improved installation efficiency. These refractory anchors will typically extend directly out to the surface of the refractory lining. A description of refractory lining techniques including refractory materials and anchoring systems may be found in Refractories Handbook, Charles Schacht (Ed), CRC Press Content, August 2004, ISBN 9780824756543, to which reference is made for a description of refractory material, systems and application techniques such as may be used for forming the refractory linings in coke drums.

The refractory material will typically be installed by hand packing, ramming or hammering an air-setting refractory mix into place within the anchoring system attached to the shell wall of the drum. Refractory ramming mixes usually contain a plastic clay which is tempered with water (typically 2-5 percent). They are commonly supplied in a damp granular form ready for installation by hand packing or by using pneumatic rammers. The mix, containing refractory minerals and clay, can also include organic plasticizers to facilitate installation. Suitable mixes can be determined upon consultation with refractory suppliers as noted above when the specific site and service duties are fixed. Typical commercial ramming mixes include Rescobond AA-22S™, Actchem™ 75, Actchem™ 85, and the ONEX™ ramming products. As noted above, selection of the specific refractory material may be made on an empirical basis in light of the applicable service specifications.

Still referring to FIG. 2, in an alternative embodiment of the invention, thermal barrier 23 is the coke itself. During the coking cycle, coke will form in anchoring system 22 and will be present to insulate the drum during the quench/fill phase, forming thermal barrier 23. Although all or part of the coke will be removed via the high pressure cutting water process during the decoke phase, the coke will replenish itself in time for the next quench/fill cycle. In this embodiment, the coke performs the same function as the refractory described above.

Figure 3:
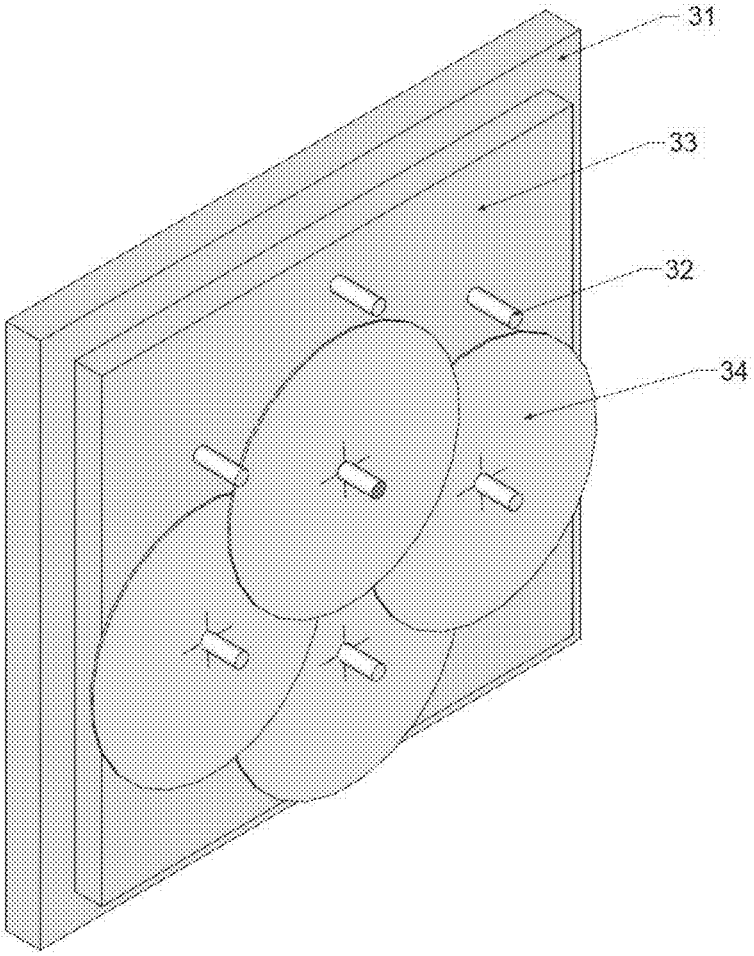
FIG. 3 illustrates an alternative embodiment of the internal lining of the present invention.

FIG. 3 shows yet another embodiment of the internal lining of the current invention. Anchoring pins 32 are connected to the inner surface of pressure boundary 31. Protective plates 34 are connected to the anchoring pins 32 so as to form an air gap. Said air gap will fill with coke creating an in situ thermal barrier 33. In this embodiment, the thermal stresses from the coking/decoking cycle are dissipated across protective plates 34 and thermal barrier 33, rather than across pressure boundary 31.

The present invention offers potential benefits in the following problem areas:

1. It minimizes and potentially mitigates thermal fatigue in coke drum shells caused by the transient thermal stress resulting from the quench/fill and heat-up steps of the decoking/coking cycle during the normal delayed coker operations. Finite Element Analyses have been performed to confirm the insulating effect of the refractory during these transient events and a reduction in thermal stress (at least one order of magnitude) in the underlying steel.
2. It minimizes or mitigates skirt-to-shell cracking by reducing the thermal stress caused by the transient temperature differential between the cone/shell of the coke drum and its skirt when coking and upon cool-down when decoking.
3. To fully capitalize on a reduced stress state at the skirt-to-shell junction, consideration may be given to positive benefits from selective external insulation removal in this area and design optimization of the skirt-to-shell junction.
4. Use of lining on the internal surface of the drum will allow operation with reduced decoking cycle time through reduced drum warm-up and/or quench/fill steps.
5. For those units that are drum-limited (i.e., where operating envelopes are established to minimize thermal stress in the drum), there are significant incentives recognized through reduced cycle times.

6. Consideration may be given to removal of external insulation if the design proves effective in providing sufficient insulating characteristics to meet the needs of operations, resulting in potential cost savings and future inspection efficiency.
7. Use of internal lining on the internal surface of the coke drum may serve to eliminate the need for 410S internal cladding commonly used for protection against high temperature sulfidation with a consequential savings in unit capital costs. Removal of the 410S cladding from the initial design will also facilitate easier permanent repairs to the coke drums in the event that fatigue cracking does occur.
8. The properties of the refractory are likely to improve during use due to the strengthening effect offered by coke impregnation. Coke-impregnated refractory shows only slight reduction in thermal properties.
9. Embodiments with refractory lining have the potential to reduce or eliminate localized erosion incurred by the high pressure cutting water.

The invention claimed is:

1. A delayed coking drum consisting of an inner surface, a top ellipsoidal or hemispherical head with a vapor outlet at the top, a bottom conical head with an outlet for coke product and a feed inlet at/near the bottom, and a vertical cylindrical section, wherein a shock-resistant and erosion-resistant internal lining is applied to the inner surface of the drum to reduce or minimize a transient thermal stress that occurs in the drum during portions of a coking cycle when the thermal stresses arise, wherein the internal lining is a refractory lining containing one of a refractory aggregate having a thermal expansion rate whereby the refractory lining delays transfer of heat from inside the drum during the coking cycle to the drum, and an aggregate that matches thermal expansion of the drum, wherein the refractory lining containing one of a refractory aggregate having a thermal expansion rate and an aggregate that matches the thermal expansion of the drum forms a thermal barrier that delays transfer of heat from inside the drum during the coking cycle to the drum.

2. A delayed coking drum according to claim 1 in which the refractory lining applied to the bottom conical head of the drum.

3. A delayed coking drum according to claim 1 in which the refractory lining is applied in a lower cylindrical section of the vertical cylindrical section of the drum.

4. A delayed coking drum according to claim 3 in which the refractory lining is applied in an upper cylindrical section of the vertical cylindrical section of the drum.

5. A delayed coking drum according to claim 1 in which the refractory lining is a monolithic lining comprising a rammed refractory secured by means of anchors attached to the inner surface of the drum.

6. A delayed coking drum according to claim 5 in which the refractory lining is a monolithic lining comprising a rammed refractory secured by means of a single point anchoring system attached to the inner surface of the drum.

7. A delayed coking drum according to claim 6 in which the single point anchoring system is attached to the inner surface of the drum by means of stud welds in which thermal strain is accumulated only across individual welds.

8. A delayed coking drum according to claim 1 in which the refractory lining has a thickness of 1.9 to 5 cm.

9. A delayed coking drum according to claim 1, wherein the internal lining includes a pin and plate assembly oriented such that the assembly forms an air gap.

10. A delayed coking drum according to claim 9 in which the assembly is applied in the lower, conical section of the drum.

11. A delayed coking drum according to claim 9 in which the assembly is applied in the lower cylindrical section of the drum.

12. A delayed coking drum according to claim 11 in which the refractory lining is applied in the upper cylindrical section of the drum.

13. A delayed coking process comprising:

heating a heavy oil feed in a furnace to a temperature at which thermal cracking is initiated, introducing the heated feed into a delayed coking drum, the delayed coking drum consisting of an inner surface, a top ellipsoidal or hemispherical head with a vapor outlet at the top, a bottom conical head with an outlet for coke product and a feed inlet at/near the bottom, and a vertical cylindrical section, wherein a shock-resistant and erosion-resistant internal lining is applied to the inner surface of the drum to reduce or minimize a transient thermal stress that occurs in the drum during portions of a coking cycle when the thermal stresses arise, wherein the internal lining is a refractory lining containing one of a refractory aggregate having a thermal expansion rate whereby the refractory lining delays transfer of heat from inside the drum during the coking cycle to the drum, and an aggregate that matches thermal expansion of the drum, wherein the refractory lining containing one of a refractory aggregate having a thermal expansion rate and an aggregate that matches the thermal expansion of the drum forms a thermal barrier that delays transfer of heat from inside the drum during the coking cycle to the drum;

coking the heated feed in the drum to produce thermally cracked hydrocarbon vapors and a coke product;

purging cracked products remaining in the drum with steam;

quenching the coke in the drum with water; and discharging the quenched coke through the coke outlet.

14. A delayed coking process according to claim 13 in which the heavy oil feed is preheated to a temperature to bring the oil into a pumpable condition in which it is fed into the furnace.

15. A delayed coking process according to claim 13 in which the preheated heavy oil feed is heated in the furnace to a temperature in the range of 380 to 525° C.

16. A delayed coking process according to claim 13 in which the heavy oil feed is heated to promote coking in the coke drum at a pressure ranging from 1 to 6 bar.

17. A delayed coking process according to claim 13 in which the refractory lining comprises a rammed refractory secured by means of anchors attached to the inner surface of the drum.

18. A delayed coking process according to claim 17 in which the refractory lining comprises a rammed refractory secured by means of a single point anchoring system attached to the inner surface of the drum.

19. A delayed coking process according to claim 18 in which the single point anchoring system is attached to the inner surface of the drum by means of stud welds in which thermal strain is accumulated only across individual welds.

20. A delayed coking process according to claim 13 in which the refractory lining has a thickness of 1.9 to 5 cm.

21. A delayed coking process according to claim 13 in which the refractory lining comprises an air-setting rammed refractory.

22. A delayed coking process according to claim 13 in which the refractory lining comprises discrete sections that are capable of passing through the coke product outlet.

23. A delayed coking process in which a heavy oil feed is heated in a furnace to a temperature at which thermal cracking is initiated comprising, introducing the heated feed into a delayed coking drum, the delayed coking drum consisting of an inner surface, a top ellipsoidal or hemispherical head with a vapor outlet at the top, a bottom conical head with an outlet for coke product and a feed inlet at/near the bottom, and a vertical cylindrical section, wherein a shock-resistant and erosion-resistant internal lining is applied to the inner surface of the drum to reduce or minimize a transient thermal stress that occurs in the drum during portions of a coking cycle when the thermal stresses arise, wherein the internal lining is a refractory lining containing one of a refractory aggregate having a thermal expansion rate whereby the refractory lining delays transfer of heat from inside the drum during the coking cycle to the drum, and an aggregate that matches thermal expansion of the drum, wherein the refractory lining containing one of a refractory aggregate having a thermal expansion rate and an aggregate that matches the thermal expansion of the drum forms a thermal barrier that delays transfer of heat from inside the drum during the coking cycle to the drum;

coking the heated feed in the drum to produce thermally cracked hydrocarbon vapors and a coke product;

purging cracked products remaining in the drum with steam;

quenching the coke in the drum with water; and discharging the quenched coke through the coke outlet;

wherein the internal lining comprises a pin and plate assembly oriented such that the assembly forms an air gap;

wherein the heated feed fills the air gap forming an in situ thermal barrier to protect the pressure boundary of the coke drum from unacceptable thermal stresses during the act of quenching the coke.

24. A delayed coking process according to claim 23 in which the heavy oil feed is preheated to a temperature to bring the oil into a pumpable condition in which it is fed into the furnace.

25. A delayed coking process according to claim 24 in which the preheated heavy oil feed is heated in the furnace to a temperature in the range of 380 to 525° C.

26. A delayed coking process according to claim 23 in which the heavy oil feed is heated to promote coking in the coke drum at a pressure ranging from 1 to 6 bar.

27. A delayed coking process in which a heavy oil feed is heated in a furnace to a temperature at which thermal cracking is initiated comprising, introducing the heated feed into a delayed coking drum, the delayed coking drum consisting of an inner surface, a top ellipsoidal or hemispherical head with a vapor outlet at the top, a bottom conical head with an outlet for coke product and a feed inlet at/near the bottom, and a vertical cylindrical section, wherein a shock-resistant and erosion-resistant internal lining is applied to the inner surface of the drum to reduce or minimize a transient thermal stress that occurs in the drum during portions of a coking cycle when the thermal stresses arise, wherein the internal lining is a refractory lining containing one of a refractory aggregate having a thermal expansion rate whereby the refractory lining delays transfer of heat from inside the drum during the coking cycle to the drum, and an aggregate that matches thermal expansion of the drum, wherein the refractory lining containing one of a refractory aggregate having a thermal expansion rate and an aggregate that matches the thermal expansion of the drum forms a thermal barrier that delays transfer of heat from inside the drum during the coking cycle to the drum;

coking the heated feed in the drum to produce thermally cracked hydrocarbon vapors and a coke product, purging cracked products remaining in the drum with steam;

quenching the coke in the drum with water; and discharging the quenched coke through the coke outlet;

wherein the internal lining comprises an anchoring system oriented such that coke from the heated feed fills voids within the anchoring system thereby forming a thermal barrier to protect the pressure boundary of the coke drum from unacceptable thermal stresses during the act of quenching the coke.

28. A delayed coking process according to claim 27 in which the heavy oil feed is preheated to a temperature to bring the oil into a pumpable condition in which it is fed into the furnace.

29. A delayed coking process according to claim 28 in which the preheated heavy oil feed is heated in the furnace to a temperature in the range of 380 to 525° C.

30. A delayed coking process according to claim 27 in which the heavy oil feed is heated to promote coking in the coke drum at a pressure ranging from 1 to 6 bar.

* * * * *